US010563548B2

(12) United States Patent
Hashimoto

(10) Patent No.: US 10,563,548 B2
(45) Date of Patent: Feb. 18, 2020

(54) SINTERED VALVE SEAT

(71) Applicant: KABUSHIKI KAISHA RIKEN, Tokyo (JP)

(72) Inventor: Kimiaki Hashimoto, Kumagaya (JP)

(73) Assignee: KABUSHIKI KAISHA RIKEN, Tokyo (JP)

( * ) Notice: Subject to any disclaimer, the term of this patent is extended or adjusted under 35 U.S.C. 154(b) by 28 days.

(21) Appl. No.: 15/764,956

(22) PCT Filed: Sep. 28, 2016

(86) PCT No.: PCT/JP2016/078632
§ 371 (c)(1),
(2) Date: Mar. 30, 2018

(87) PCT Pub. No.: WO2017/057464
PCT Pub. Date: Apr. 6, 2017

(65) Prior Publication Data

US 2018/0283234 A1 Oct. 4, 2018

(30) Foreign Application Priority Data

Oct. 2, 2015 (JP) ..... 2015-196642

(51) Int. Cl.
*C22C 38/00* (2006.01)
*B22F 1/00* (2006.01)
(Continued)

(52) U.S. Cl.
CPC ..... *F01L 3/02* (2013.01); *B22F 1/007* (2013.01); *B22F 1/0011* (2013.01); *B22F 5/008* (2013.01);
(Continued)

(58) Field of Classification Search
None
See application file for complete search history.

(56) References Cited

U.S. PATENT DOCUMENTS 4,424,953 A * 1/1984 Takagi ..... B22F 7/06 123/188.8
5,004,581 A 4/1991 Takagi et al.
(Continued)

FOREIGN PATENT DOCUMENTS

JP 03-60895 A 3/1991
JP 05-202451 A 8/1993
(Continued)

OTHER PUBLICATIONS

International Search Report for PCT/JP2016/078632 (PCT/ISA/210) dated Nov. 22, 2016.
(Continued)

*Primary Examiner* — Kevin F Murphy
*Assistant Examiner* — Kelsey E Cary
(74) *Attorney, Agent, or Firm* — Birch, Stewart, Kolasch & Birch, LLP

(57) ABSTRACT

To provide a press-fitting, sintered valve seat having excellent valve coolability enabling use in high-efficiency engines, as well as excellent deformation resistance and wear resistance, first and second hard particles differing in hardness are dispersed in a total amount of 25-70% by mass in a network-shaped Cu matrix, the second hard particles having hardness of 300-650 HV0.1, lower than that of the first hard particles, and 0.08-2.2% by mass of P is contained in the sintered valve seat.

19 Claims, 1 Drawing Sheet

(51) Int. Cl.

| | |
|---|---|
| ***F01L 3/02*** | (2006.01) |
| ***C22C 19/07*** | (2006.01) |
| ***C22C 38/24*** | (2006.01) |
| ***C22C 38/34*** | (2006.01) |
| ***C22C 1/04*** | (2006.01) |
| ***C22C 32/00*** | (2006.01) |
| ***B22F 5/00*** | (2006.01) |
| ***C22C 38/02*** | (2006.01) |
| ***C22C 38/04*** | (2006.01) |
| ***C22C 38/22*** | (2006.01) |

(52) U.S. Cl.

CPC ..... *C22C 1/04* (2013.01); *C22C 1/0425* (2013.01); *C22C 19/07* (2013.01); *C22C 32/0021* (2013.01); *C22C 32/0047* (2013.01); *C22C 32/0078* (2013.01); *C22C 38/00* (2013.01); *C22C 38/02* (2013.01); *C22C 38/04* (2013.01); *C22C 38/22* (2013.01); *C22C 38/24* (2013.01); *C22C 38/34* (2013.01); *B22F 2201/20* (2013.01); *B22F 2301/10* (2013.01); *B22F 2301/15* (2013.01); *B22F 2301/35* (2013.01); *B22F 2304/10* (2013.01); *B22F 2998/10* (2013.01); *B22F 2999/00* (2013.01); *F01L 2103/01* (2013.01); *F01L 2810/02* (2013.01); *F01L 2820/01* (2013.01)

(56) References Cited

U.S. PATENT DOCUMENTS

| | | | | |
|---|---|---|---|---|
| 5,975,039 | A | 11/1999 | Oshige | |
| 6,039,785 | A | 3/2000 | Dalal et al. | |
| 6,793,876 | B2 | 9/2004 | Kawakami et al. | |
| 7,273,508 | B2 | 9/2007 | Sato et al. | |
| 7,666,246 | B2 | 2/2010 | Matsuki et al. | |
| 7,811,511 | B2 | 10/2010 | Matsuki et al. | |
| 2004/0131492 | A1 | 7/2004 | Kawakami et al. | |
| 2005/0193861 | A1 | 9/2005 | Sato et al. | |
| 2006/0278038 | A1* | 12/2006 | Kawata | C22C 1/05 75/230 |
| 2007/0057238 | A1 | 3/2007 | Matsuki et al. | |
| 2007/0081914 | A1* | 4/2007 | Yoshihiro | C22C 1/051 419/11 |
| 2010/0104466 | A1 | 4/2010 | Matsuki et al. | |
| 2011/0023808 | A1* | 2/2011 | Sato | C22C 1/0491 123/188.8 |
| 2015/0275343 | A1* | 10/2015 | Oshige | B22F 5/008 277/502 |

FOREIGN PATENT DOCUMENTS

| | | | |
|---|---|---|---|
| JP | 07-119421 | A | 5/1995 |
| JP | 3579561 | B2 | 10/2004 |
| JP | 2005-248234 | A | 9/2005 |
| JP | 3786267 | B2 | 6/2006 |
| JP | 2007-077438 | A | 3/2007 |
| JP | 4272706 | B2 | 6/2009 |

OTHER PUBLICATIONS

Written Opinion of the International Searching Authority for PCT/JP2016/078632 (PCT/ISA/237) dated Nov. 22, 2016.

* cited by examiner

SINTERED VALVE SEAT

FIELD OF THE INVENTION

The present invention relates to a valve seat for engines, particularly to a press-fitting, high-thermal-conductivity, sintered valve seat capable of suppressing the temperature elevation of a valve.

BACKGROUND OF THE INVENTION

To provide automobile engines with improved fuel efficiency and higher performance for environmental protection, so-called downsizing for reducing engine displacement by 20-50% is recently accelerated. Also, direct-injection engines are combined with turbochargers to increase compression ratios. Improvement in the efficiency of engines inevitably results in higher engine temperatures, which may cause power-decreasing knocking. Accordingly, improvement in the coolability of parts particularly around valves has become necessary.

As a means for improving coolability, Patent Reference 1 discloses a method for producing an engine valve comprising sealing metal sodium (Na) in a hollow portion of a hollow valve stem. With respect to a valve seat, Patent Reference 2 teaches a method for directly buildup-welding a valve seat on a cylinder head of an aluminum (Al) alloy by high-density heating energy such as laser beams to improve the coolability of a valve, which is called "laser cladding method." As an alloy for buildup-welding the valve seat, Patent Reference 2 teaches a dispersion-strengthened Cu-based alloy comprising boride and silicide particles of Fe—Ni dispersed in a copper (Cu)-based matrix, Sn and/or Zn being dissolved in primary Cu-based crystals.

The valve temperature during the operation of an engine is about 150° C. lower in the above metal-sodium-filled valve (valve temperature: about 600° C.) than in a solid valve, and the Cu-based alloy valve seat produced by the laser cladding method lowers the temperature (about 700° C.) of a solid valve by about 50° C., preventing knocking. However, the metal-sodium-filled valves suffer such a high production cost that they are not used widely except some vehicles. The Cu-based alloy valve seats produced by the laser cladding method, which do not contain hard particles, have insufficient wear resistance, suffering seizure by impact wear. Also, the direct buildup-welding on cylinder heads needs the drastic change of cylinder head production lines and large facility investment.

With respect to a valve seat press-fit into a cylinder head, Patent Reference 3 discloses a two-layer structure comprising a valve-abutting layer formed by Cu powder or Cu-containing powder (sintered iron alloy layer containing 7-17% of Cu) and a valve seat body layer (sintered iron alloy layer containing 7-20% of Cu) for improving thermal conduction, and Patent Reference 4 discloses a sintered Fe-based alloy having porosity of 10-20% by dispersed hard particles, which is impregnated with Cu or its alloy.

Further, Patent Reference 5 discloses a sintered Cu-based alloy valve seat, in which hard particles are dispersed in a dispersion-hardened Cu-based alloy having excellent thermal conductivity. Specifically, a starting powder mixture comprising 50-90% by weight of Cu-containing matrix powder and 10-50% by weight of a powdery Mo-containing alloy additive, the Cu-containing matrix powder being $Al_2O_3$-dispersion-hardened Cu powder, and the powdery Mo-containing alloy additive comprising 28-32% by weight of Mo, 9-11% by weight of Cr, and 2.5-3.5% by weight of Si, the balance being Co.

However, the Cu content of at most about 20% in Patent References 3 and 4 fails to sufficiently improve the thermal conductivity. Though Patent Reference 5 teaches that $Al_2O_3$-dispersion-hardened Cu powder can be produced by heat-treating Cu—Al alloy powder atomized from a Cu—Al alloy melt in an oxidizing atmosphere for selective oxidation of Al, there is actually limit of increasing the purity of an $Al_2O_3$-dispersed Cu matrix formed from an Al-dissolved Cu—Al alloy. The inclusion of more hard particles (for example, 40-50% by weight) increases attackability to a valve, a mating member, and the inclusion of less hard particles (for example, 10-20% by weight) deteriorates the deformation resistance and wear resistance of the valve seat, resulting in remarkably contradictory tendency with respect to the amount of hard particles.

PRIOR ART REFERENCES

Patent Reference 1: JP 7-119421 A
Patent Reference 2: JP 3-60895 A
Patent Reference 3: JP 3579561 B
Patent Reference 4: JP 3786267 B
Patent Reference 5: JP 4272706 B

Object of the Invention

In view of the above problems, an object of the present invention is to provide a press-fitting, sintered valve seat having excellent valve coolability to be usable for high-efficiency engines, as well as excellent deformation resistance and wear resistance.

SUMMARY OF THE INVENTION

As a result of intensive research on sintered valve seats containing hard particles dispersed in Cu or its alloy having excellent thermal conductivity, the inventor has found that using hard particles in an amount capable of preventing the deformation of Cu or its alloy, with part of them replaced by those having lower hardness, a press-fitting, sintered valve seat having excellent deformation resistance and wear resistance, as well as high valve coolability, while keeping high thermal conductivity by Cu or its alloy can be obtained.

Thus, the sintered valve seat of the present invention comprises hard particles dispersed in a matrix of Cu or its alloy;

- the hard particles being composed of at least one type of first hard particles, and at least one type of second hard particles;
- the total amount of the first and second hard particles being 25-70% by mass;
- the second hard particles having hardness of 300-650 HV0.1, lower than that of the first hard particles; and
- the sintered valve seat containing 0.08-2.2% by mass of P (phosphorus).

It is preferable that the first hard particles having hardness of 550-2400 HV0.1 are dispersed in an amount of 10-35% by mass in the sintered valve seat. The first hard particles more preferably have hardness of 550-900 HV0.1. Hardness difference between the lowest-hardness particles among the first hard particles and the highest-hardness particles among the second hard particles is preferably 30 HV0.1 or more.

The hard particles preferably have a median diameter of 10-150

The sintered valve seat preferably contains up to 7% by mass of Sn.

The sintered valve seat preferably contains up to 1% by mass of a solid lubricant. The solid lubricant is preferably at least one selected from the group consisting of C, BN, MnS, $CaF_2$, $WS_2$ and $Mo_2S$.

The first hard particles are preferably made of at least one selected from the group consisting of a Co—Mo—Cr—Si alloy comprising by mass 27.5-30.0% of Mo, 7.5-10.0% of Cr, and 2.0-4.0% of Si, the balance being Co and inevitable impurities; an Fe—Mo—Cr—Si alloy comprising by mass 27.5-30.0% of Mo, 7.5-10.0% of Cr, and 2.0-4.0% of Si, the balance being Fe and inevitable impurities; a Co—Cr—W—C alloy comprising by mass 27.0-32.0% of Cr, 7.5-9.5% of W, and 1.4-1.7% of C, the balance being Co and inevitable impurities; a Co—Cr—W—C alloy comprising by mass 27.0-32.0% of Cr, 4.0-6.0% of W, and 0.9-1.4% of C, the balance being Co and inevitable impurities; and a Co—Cr—W—C alloy comprising by mass 28.0-32.0% of Cr, 11.0-13.0% of W, and 2.0-3.0% of C, the balance being Co and inevitable impurities. In addition to the above hard particles, hard particles made of at least one selected from the group consisting of an Fe—Mo—Si alloy comprising by mass 40-70% of Mo, and 0.4-2.0% of Si, the balance being Fe and inevitable impurities, and SiC are preferably further contained.

The second hard particles are preferably made of at least one selected from the group consisting of alloy tool steel comprising by mass 1.4-1.6% of C, 0.4% or less of Si, 0.6% or less of Mn, 11.0-13.0% of Cr, 0.8-1.2% of Mo, and 0.2-0.5% of V, the balance being Fe and inevitable impurities; alloy tool steel comprising by mass 0.35-0.42% of C, 0.8-1.2% of Si, 0.25-0.5% of Mn, 4.8-5.5% of Cr, 1-1.5% of Mo, and 0.8-1.15% of V, the balance being Fe and inevitable impurities; high-speed tool steel comprising by mass 0.8-0.88% of C, 0.45% or less of Si, 0.4% or less of Mn, 3.8-4.5% of Cr, 4.7-5.2% of Mo, 5.9-6.7% of W, and 1.7-2.1% of V, the balance being Fe and inevitable impurities, and low-alloy steel comprising by mass 0.01% or less of C, 0.3-5.0% of Cr, and 0.1-2.0% of Mo, the balance being Fe and inevitable impurities.

Effects of the Invention

In the sintered valve seat of the present invention, a relatively large amount of hard particles in contact with or close to each other form a skeleton structure to suppress the deformation of Cu or its alloy, and part of the hard particles are replaced by lower-hardness particles to prevent the sintered valve seat from having too high hardness, thereby providing well-balanced deformation resistance and wear resistance. The first hard particles may be in a particle shape ensuring a high filling density, preferably in a spherical shape ensuring densification. The second hard particles having lower hardness are in an irregular shape increasing the contact of hard particles, thereby contributing to the formation of a dense skeleton structure. Of course, fine Cu powder can be used to form a network-shaped Cu matrix, and the densification provides excellent wear resistance while keeping high thermal conductivity. Accordingly, the coolability of a valve is improved to reduce the abnormal combustion of engines such as knocking, etc., thereby improving the performance of high-compression-ratio, high-efficiency engines.

DESCRIPTION OF THE PREFERRED EMBODIMENTS

Figure 1:
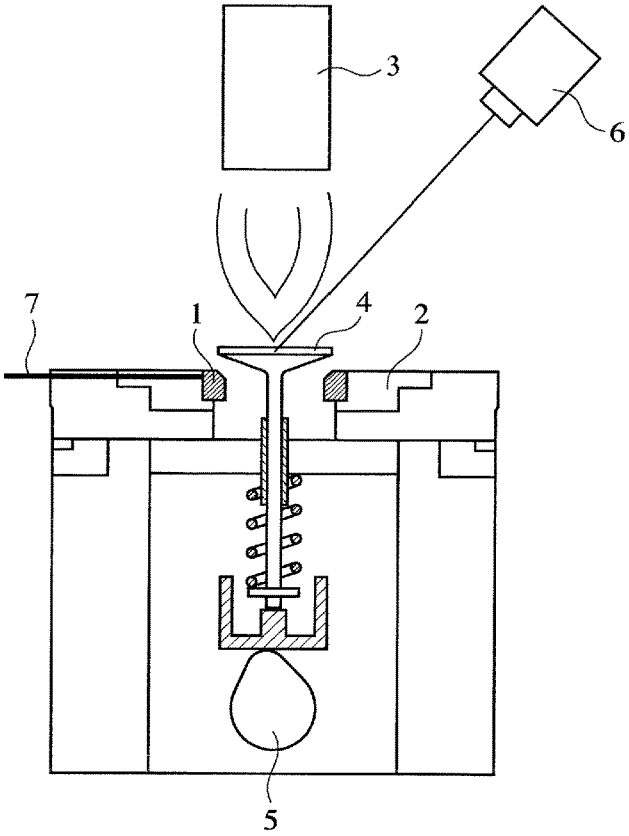
FIG. 1 is a view schematically showing a rig test machine.

The sintered valve seat of the present invention has a structure in which first and second hard particles differing in hardness are dispersed in a matrix of Cu or its alloy. Because the hard particles improve the wear resistance of a valve seat, and keep the shape of the valve seat by forming skeleton in a soft matrix of Cu or its alloy, the total amount of the first and second hard particles is 25-70% by mass. When the total amount of hard particles is less than 25% by mass, it is difficult to keep the shape of the valve seat. On the other hand, the total amount of hard particles exceeding 70% by mass provides the valve seat with too small a percentage of a matrix of Cu or its alloy to obtain desired thermal conductivity, and increases its attackability to a valve, thereby wearing the valve. The total amount of hard particles is preferably 30-65% by mass, more preferably 35-60% by mass. The second hard particles have hardness of 300-650 HV0.1, lower than that of the first hard particles. The hardness of less than 300 HV0.1 fails to provide the second hard particles with sufficient roll as hard particles, and the hardness exceeding 650 HV0.1 increases attackability to a valve like the first hard particles. The hardness of the second hard particles is preferably 400-630 HV0.1, more preferably 550-610 HV0.1. Among the entire hard particles, the amount of the second hard particles dispersed is preferably 5-35% by mass, more preferably 15-35% by mass, further preferably 21-35% by mass.

The sintered valve seat of the present invention contains 0.08-2.2% by mass of P, because Fe—P alloy powder is added to densify the sintered body. Commercially available Fe—P alloy powder contains 15-32% by mass of P. For example, when an Fe—P alloy containing 26.7% by mass of P is used, the amount of the Fe—P alloy to be added is 0.3-8.2% by mass. When P is less than 0.08% by mass, the sintered body is not sufficiently densified. Because P forms compounds with Co, Cr, Mo, etc., the upper limit of the P content is 2.2% by mass. The upper limit of the P content is preferably 1.87% by mass, more preferably 1.7% by mass or less, further preferably 1.0% by mass.

For densification by liquid-phase sintering, Ni—P alloy powder having a eutectic point at 870° C. can be used in place of the Fe—P alloy powder having eutectic points at 1048° C. and 1262° C. However, because Ni forms a solid solution with Cu at any mixing ratio, lowering the thermal conductivity, it is preferable to use the powder of the Fe—P alloy, an Fe alloy forming substantially no solid solution with Cu at 500° C. or lower, from the aspect of thermal conductivity.

The sintered valve seat of the present invention may contain up to 7% by mass of Sn, namely 0-7% by mass of Sn, for the densification of a sintered body like the Fe—P alloy powder. The addition of a small amount of Sn to a Cu matrix contributes to densification by forming a liquid phase during sinter. However, the addition of too much Sn lowers the thermal conductivity of a Cu matrix, and increases a $Cu_3Sn$ compound having low toughness and strength, deteriorating wear resistance. Accordingly, the upper limit of Sn is 7% by mass. The amount of Sn added is preferably 0.3-2.0% by mass, more preferably 0.3-1.0% by mass.

The first hard particles used in the sintered valve seat of the present invention are required to be harder than the second hard particles, and the hardness of the first hard particles is preferably 550-2400 HV0.1. As their hardness becomes from 550-1200 HV0.1 to 550-900 HV0.1 and to 600-850 HV0.1, and particularly to 650-800 HV0.1, the sintered valve seat becomes more preferable. The amount of the first hard particles dispersed in the matrix is preferably 10-35% by mass, more preferably 13-32% by mass, further preferably 15-30% by mass. With respect to the relation with the second hard particles, hardness difference between the lowest-hardness particles among the first hard particles and the highest-hardness particles among the second hard particles is preferably 30 HV0.1 or more, more preferably 60 HV0.1 or more, further preferably 90 HV0.1 or more.

Because the above hard particles form a skeleton in a soft matrix of Cu or its alloy, their median diameter is preferably 10-150 The median diameter, which corresponds to a diameter d50 at a cumulative volume of 50% in a curve of cumulative volume (obtained by cumulating the particle volume in a diameter range equal to or less than a particular diameter) relative to diameter, can be determined, for example, by using MT3000 II series available from MicrotracBEL Corp. The median diameter is more preferably 50-100 μm, further preferably 65-85 μm.

In the sintered valve seat of the present invention, the first hard particles are preferably in a spherical shape, and the second hard particles are preferably in an irregular shape. Particularly, because the first hard particles having higher hardness are less deformable, tending to hinder densification, they are preferably in a spherical shape for higher fillability. On the other hand, because the second hard particles having lower hardness are easily deformable, they are preferably in an irregular, non-spherical shape to form a skeleton structure with higher contact density of hard particles. Spherical hard particles can be produced by gas atomizing, and irregular, non-spherical hard particles can be produced by pulverization or water atomizing.

It is important that the above hard particles are not substantially dissolved in matrix-forming Cu. Because Co and Fe are hardly dissolved in Cu at 500° C. or lower, it is preferable to use Co-based or Fe-based hard particles. Further, because Mo, Cr, V and W are also hardly soluble in Cu at 500° C. or lower, they can be used as main alloy elements. As the first hard particles having higher hardness, Co—Mo—Cr—Si alloy powder, Fe—Mo—Cr—Si alloy powder and Co—Cr—W—C alloy powder are preferably selected. Particularly when wear resistance is strongly demanded, Fe—Mo—Si alloy powder and SiC are preferably selected. As the second hard particles softer than the first hard particles, Fe-based alloy tool steel powder, high-speed tool steel powder and low-alloy steel powder are preferably selected. Though Si and Mn are soluble in Cu, the deterioration of hard particles and a remarkable reaction with the matrix can be avoided as long as their amounts are limited to predetermined levels.

The sintered valve seat of the present invention may contain a solid lubricant if necessary. For example, in direct-injection engines undergoing sliding without fuel lubrication, it is necessary to add a solid lubricant to increase self-lubrication, thereby keeping wear resistance. Accordingly, the sintered valve seat of the present invention may contain up to 1% by mass, namely 0-1% by mass, of a solid lubricant. The solid lubricant is selected from carbon, nitrides, sulfides and fluorides, preferably at least one selected from the group consisting of C, BN, MnS, $CaF_2$, $WS_2$ and $Mo_2S$.

The matrix-forming Cu powder preferably has an average diameter of 45 μm or less and purity of 99.5% or more. By using Cu powder having a smaller average diameter than that of hard particles for high fillability, a network-shaped Cu matrix can be formed even with a relatively large amount of hard particles. For example, the hard particles preferably have an average diameter of 45 μm or more, and the Cu powder preferably has an average diameter of 30 μm or less. The Cu powder is preferably atomized spherical powder. Dendritic electrolytic Cu powder having fine projections for easy connection is also preferably usable to form a network-shaped matrix.

In the method for producing the sintered valve seat of the present invention, Cu powder, Fe—P alloy powder or Fe—P alloy powder and Sn powder, and the first and second hard particle powder, and if necessary a solid lubricant are mixed, and the resultant mixture powder is compression-molded and sintered. For higher moldability, 0.5-2% by mass of stearate as a parting agent may be added to the mixture powder. The sintering of a green compact is conducted at a temperature ranging from 850° C. to 1070° C. in vacuum or in a non-oxidizing or reducing atmosphere.

Example 1

Electrolytic Cu powder having an average diameter of 22 μm and purity of 99.8% was mixed with 35% by mass of Co—Mo—Cr—Si alloy powder 1A having a median diameter of 72 μm and comprising by mass 28.5% of Mo, 8.5% of Cr, and 2.6% of Si, the balance being Co and inevitable impurities, which was a mixture of spherical particles and irregular-shaped particles, as the first hard particles; 15% by mass of high-speed tool steel powder 2A having a median diameter of 84 μm and comprising by mass 0.85% of C, 0.3% of Si, 0.3% of Mn, 3.9% of Cr, 4.8% of Mo, 6.1% of W, and 1.9% of V, the balance being Fe and inevitable impurities, which were in an irregular shape, as the second hard particles; and 1.0% by mass of Fe—P alloy powder containing 26.7% by mass of P as a sintering aid, to produce a mixture powder in a mixer. Incidentally, 0.5% by mass of zinc stearate for good parting in the molding step was added to each starting material powder.

The mixture powder was compression-molded at a 640 MPa in a press mold, and sintered at a temperature of 1050° C. in vacuum to produce a ring-shaped sintered body of 37.6 mm in outer diameter, 21.5 mm in inner diameter and 8 mm in thickness. The ring-shaped sintered body was then machined to provide a valve seat sample of 26.3 mm in outer diameter, 22.1 mm in inner diameter and 6 mm in height, which had a face inclined 45° from the axial direction. Composition analysis revealed that the valve seat contained 0.27% by mass of P. This analysis result of the P content is reflected by the amount of the Fe—P alloy powder added.

Figure 2:
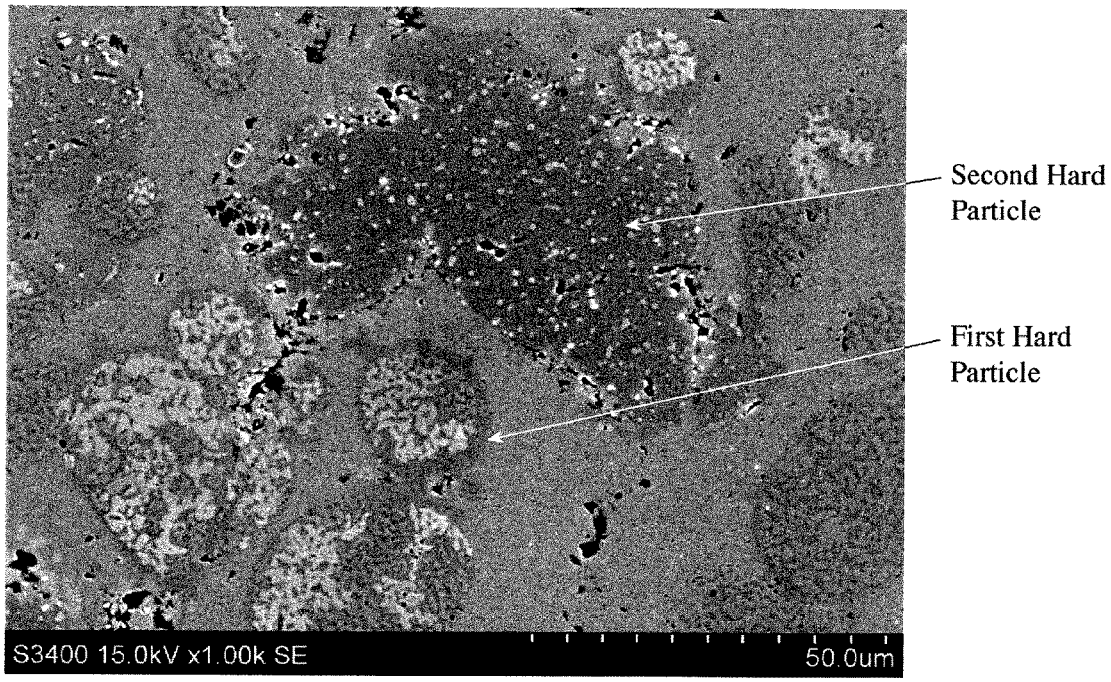
FIG. 2 is a scanning electron photomicrograph (1000 times) showing a cross-section structure of the sintered body of Example 1 in the present invention.

After mirror-polishing a cross section of the sintered body of Example 1, Vickers hardness was measured under a load of 0.98 N at 5 points in each of the first hard particles 1A, the second hard particles 2A, and the matrix, and averaged. As a result, the hardness of the first hard particles 1A was 720 HV0.1, the hardness of the second hard particles 2A was 632 HV0.1, and the hardness of the matrix was 121 HV0.1. FIG. 2 is a scanning electron photomicrograph showing a cross-section structure of the sintered body of Example 1.

Comparative Example 1

Using a sintered Fe-based alloy containing 10% by mass of Fe—Mo—Si alloy powder having a median diameter of 78 μm and comprising by mass 60.1% of Mo and 0.5% of Si, the balance being Fe and inevitable impurities (corresponding to the later-described first hard particles 1C), as hard particles, a valve seat sample having the same shape as in Example 1 was produced. The Fe—Mo—Si alloy particles had hardness of 1190 HV0.1, and the matrix had hardness of 148 HV0.1.

[1] Measurement of Valve Coolability (Valve Temperature)

Using the rig test machine shown in FIG. 1 the temperature of a valve was measured to evaluate valve coolability. The valve seat sample 1 was press-fit into a valve seat holder 2 made of a cylinder head material (Al alloy, AC4A), and set in the test machine. The rig test was conducted by moving a valve 4 (SUH alloy, JIS G4311) up and down by rotating a cam 5 while heating the valve 4 by a burner 3. With constant heating by keeping constant the flow rates of air and gas in the burner 3 and the position of the burner, the valve coolability was determined by measuring the temperature of a center portion of a valve head by a thermograph 6. The flow rates of air and gas in the burner 3 were 90 L/min and 5.0 L/min, respectively, and the rotation speed of the cam was 2500 rpm. 15 minutes after starting the operation, a saturated valve temperature was measured. In this Example, the valve coolability was expressed by decrease (minus value) from the valve temperature in Comparative Example 1, in place of the saturated valve temperature changeable depending on heating conditions, etc. Though the saturated valve temperature was higher than 800° C. in Comparative Example 1, it was lower than 800° C. in Example 1, with the valve coolability of −32° C.

[2] Wear Test

After the valve coolability was evaluated, wear resistance was evaluated using the rig test machine shown in FIG. 1. The evaluation was conducted by a thermocouple 7 embedded in the valve seat 1, with the power of the burner 3 adjusted to keep an abutting surface of the valve seat at a predetermined temperature. The wear was expressed by the receding height of the abutting surface determined by the measurement of the shapes of the valve seat and the valve before and after the test. The valve 4 (SUH alloy) used was formed by a Co alloy (Co-20% Cr-8% W-1.35% C-3% Fe) buildup-welded to a size fit to the above valve seat. The test conditions were a temperature of 300° C. (at the abutting surface of the valve seat), a cam rotation speed of 2500 rpm, and a test time of 5 hours. The wear was expressed by a ratio to the wear in Comparative Example 1, which was assumed as 1. The wear in Example 1 was 0.84 in the valve seat and 0.85 in the valve, as compared with 1 in Comparative Example 1.

Examples 2-21, and Comparative Examples 2-5

In Examples 2-21 and Comparative Examples 2-5, the first hard particles shown in Table 1, and the second hard particles shown in Table 2 were used in the amounts shown in Table 3. Table 3 shows the amounts of the Fe—P alloy powder, the Sn powder, the solid lubricant powder, and the first and second hard particles. Table 1 also shows those in Example 1.

TABLE 1

| First Hard Particles | | | |
|---|---|---|---|
| Type | Composition (% by mass) | d50 (μm) | Shape |
| 1A | Co—28.5% Mo—8.5% Cr—2.6% Si | 72 | Spherical + Irregular |
| 1B | Fe—29.1% Mo—7.9% Cr—2.2% Si | 66 | Spherical + irregular |
| 1C | Fe—60.1% Mo—0.5% Si | 78 | Irregular |
| 1D | SiC | 51 | Spherical |
| 1E | Co—30.0% Cr—8.0% W—1.6% C | 55 | Spherical |
| 1F | Co—28.0% Cr—4.0% W—1.1% C | 69 | Spherical |
| 1G | Co—30.0% Cr—12.0% W—2.5% C | 83 | Spherical |

TABLE 2

| Second Hard Particles | | | |
|---|---|---|---|
| Type | Composition ((% by mass) | d50 (μm) | Shape |
| 2A | Fe—0.85% C—0.3% Si—0.3% Mn—3.9% Cr—4.8% Mo—6.1% W—1.9% V | 84 | Irregular |
| 2B | Fe—0.39% C—0.92% Si—0.34% Mn—5.1% Cr—1.2% Mo—1.1% V | 88 | Irregular |
| 2C | Fe—1.52% C—0.3% Si—0.3% Mn—11.8% Cr—1.1% Mo—0.3% V | 61 | Irregular |
| 2D | Fe—3.0% Cr—0.5% Mo | 67 | Irregular |

TABLE 3

| | First Hard Particles | | Second Hard Particles | | Fe—P* | Sn | Solid Lubricant | |
|---|---|---|---|---|---|---|---|---|
| No. | Type | Amount % ** | Type | Amount % ** | Amount % ** | Amount % ** | Type | Amount % ** |
| Example 1 | 1A | 35 | 2A | 15 | 1 | — | — | — |
| Example 2 | 1A | 25 | 2B | 25 | 0.5 | 1 | — | — |
| Example 3 | 1A | 28 | 2A | 12 | 0.5 | 0.5 | — | — |
| Example 4 | 1B | 35 | 2A | 15 | 1 | 1 | — | — |
| Example 5 | 1B | 21 | 2B | 21 | 1 | 0.5 | — | — |
| Example 6 | 1A | 17.5 | 2B | 7.5 | 2 | 0.3 | — | — |
| Example 7 | 1B | 30 | 2B | 30 | 0.3 | 2 | — | — |
| Example 8 | 1B | 30 | 2C | 30 | 6.5 | 6.5 | — | — |
| Example 9 | 1A | 38 | 2A | 12 | 0.5 | 1 | — | — |
| Example 10 | 1A | 8 | 2A | 35 | 0.5 | 1 | — | — |
| Example 11 | 1A, 1B | 20, 5 | 2A | 25 | 1 | 1 | — | — |
| Example 12 | 1A | 18 | 2A, 2B | 20, 10 | 1.5 | — | — | — |
| Example 13 | 1A, 1C | 10, 15 | 2A, 2D | 10, 15 | 2 | 0.5 | — | — |
| Example 14 | 1A, 1D | 20, 5 | 2D | 25 | 1.5 | 0.5 | — | — |
| Example 15 | 1A, 1E | 18, 7 | 2B, 2C | 15, 10 | 1 | — | — | — |

TABLE 3-continued

| | First Hard Particles | | Second Hard Particles | | Fe—P* | Sn | Solid Lubricant | |
|---|---|---|---|---|---|---|---|---|
| No. | Type | Amount % ** | Type | Amount % ** | Amount % ** | Amount % ** | Type | Amount % ** |
| Example 16 | 1F, 1G | 15, 15 | 2D | 20 | 1 | — | C | 0.8 |
| Example 17 | 1C, 1E | 8, 17 | 2B | 23 | 1 | 0.5 | BN | 0.3 |
| Example 18 | 1D, 1G | 8, 12 | 2A | 28 | 1.5 | 0.5 | MnS | 1.0 |
| Example 19 | 1B, 1F | 18, 12 | 2A, 2B | 7, 8 | 1.5 | — | $CaF_2$ | 0.5 |
| Example 20 | 1A, 1C, 1E | 15, 8, 7 | 2D | 30 | 1 | 0.5 | — | — |
| Example 21 | 1B | 25 | 2A, 2B, 2D | 8, 7, 10 | 1 | 0.5 | — | — |
| Com. Ex. 2 | 1A | 35 | 2A | 30 | 8.5 | 7.5 | — | — |
| Com. Ex. 3 | 1B | 35 | 2B | 30 | 8.5 | 7.5 | — | — |
| Com. Ex. 4 | 1A | 10 | 2B | 10 | 0.2 | — | — | — |
| Com. Ex. 5 | 1B | 37 | 2B | 37 | 1 | 1 | — | — |

*Fe—P alloy powder containing 26.7% by mass of P.
** Expressed by "% by mass."

The valve seat samples of Examples 2-21 and Comparative Examples 2-5 were produced, and subjected to the analysis of P, the measurement of Vickers hardness of the first and second hard particles and the matrix, the measurement of valve coolability, and the wear test, in the same manner as in Example 1.

The results of Examples 2-21 and Comparative Examples 2-5 are shown in Tables 4 and 5, together with those of Example 1 and Comparative Example 1.

TABLE 4

| | | Vickers Hardness (HV0.1) | | |
|---|---|---|---|---|
| No. | P (% by mass) | First Hard Particles | Second Hard Particles | Matrix |
| Example 1 | 0.27 | 723 | 632 | 121 |
| Example 2 | 0.13 | 721 | 582 | 138 |
| Example 3 | 0.14 | 734 | 630 | 132 |
| Example 4 | 0.26 | 678 | 644 | 141 |
| Example 5 | 0.27 | 672 | 609 | 132 |
| Example 6 | 0.55 | 704 | 603 | 155 |
| Example 7 | 0.08 | 666 | 600 | 144 |
| Example 8 | 1.75 | 657 | 551 | 163 |
| Example 9 | 0.14 | 708 | 628 | 134 |
| Example 10 | 0.13 | 714 | 637 | 128 |
| Example 11 | 0.26 | 724, 653 | 603 | 121 |
| Example 12 | 0.40 | 733 | 601, 553 | 126 |
| Example 13 | 0.54 | 724, 1263 | 611, 301 | 131 |
| Example 14 | 0.39 | 720, 2302 | 302 | 127 |
| Example 15 | 0.27 | 722, 770 | 578, 309 | 125 |
| Example 16 | 0.24 | 753, 711 | 312 | 134 |
| Example 17 | 0.26 | 1188, 763 | 560 | 128 |
| Example 18 | 0.40 | 2311, 718 | 622 | 130 |
| Example 19 | 0.39 | 674, 764 | 632, 578 | 127 |
| Example 20 | 0.27 | 720, 1182, 780 | 340 | 122 |
| Example 21 | 0.27 | 653 | 611, 563, 316 | 123 |
| Com. Ex. 1 | — | 1190 | — | 148 |
| Com. Ex. 2 | 2.25 | 732 | 640 | 173 |
| Com. Ex. 3 | 2.25 | 683 | 622 | 168 |
| Com. Ex. 4 | 0.05 | 721 | 610 | 110 |
| Com. Ex. 5 | 0.27 | 683 | 607 | 166 |

TABLE 5

| | Wear Test | | Valve |
|---|---|---|---|
| No. | Seat Wear (μm) | Valve Wear (μm) | Coolability (° C.) |
| Example 1 | 0.84 | 0.85 | −32 |
| Example 2 | 0.85 | 0.86 | −32 |

TABLE 5-continued

| | Wear Test | | Valve |
|---|---|---|---|
| No. | Seat Wear (μm) | Valve Wear (μm) | Coolability (° C.) |
| Example 3 | 0.90 | 0.89 | −58 |
| Example 4 | 0.83 | 0.85 | −30 |
| Example 5 | 0.92 | 0.95 | −53 |
| Example 6 | 0.95 | 0.90 | −60 |
| Example 7 | 0.80 | 0.85 | −28 |
| Example 8 | 0.82 | 0.88 | −20 |
| Example 9 | 0.79 | 0.98 | −36 |
| Example 10 | 0.99 | 0.87 | −49 |
| Example 11 | 0.84 | 0.88 | −49 |
| Example 12 | 0.86 | 0.91 | −47 |
| Example 13 | 0.92 | 0.93 | −50 |
| Example 14 | 0.88 | 0.86 | −52 |
| Example 15 | 0.89 | 0.88 | −52 |
| Example 16 | 0.90 | 0.86 | −55 |
| Example 17 | 0.87 | 0.87 | −48 |
| Example 18 | 0.86 | 0.89 | −44 |
| Example 19 | 0.90 | 0.87 | −47 |
| Example 20 | 0.84 | 0.88 | −48 |
| Example 21 | 0.90 | 0.90 | −44 |
| Com. Ex. 1 | 1 | 1 | — |
| Com. Ex. 2 | 1.1 | 1.2 | −6 |
| Com. Ex. 3 | 1.2 | 1.25 | −8 |
| Com. Ex. 4 | 1.5 | 1.6 | −59 |
| Com. Ex. 5 | 1.05 | 1.19 | −7 |

The valve seat coolability was improved as the total amount of hard particles decreased, and as the amount of Fe—P and Sn decreased, namely as the percentage of Cu in the matrix increased, and as the purity became higher. With a smaller total amount of hard particles (20% by mass in Comparative Example 4), the seat and the valve were more worn despite higher valve seat coolability. This seems to be due to the fact that as small as 0.2% by mass of Fe—P provided insufficient densification, resulting in increased valve attackability.

DESCRIPTION OF REFERENCE NUMERALS

1: Valve seat
2: Valve seat holder
3: Burner
4: Valve
5: Cam
6: Thermograph
7: Thermocouple

What is claimed is:

1. A sintered valve seat comprising hard particles dispersed in a matrix of Cu or its alloy, said hard particles being composed of first hard particles and second hard particles;

the total amount of said first and second hard particles being 25-70% by mass;

said second hard particles having hardness of 300-650 HV0.1, lower than that of said first hard particles; and said sintered valve seat containing 0.08-2.2% by mass of P, wherein said first hard particles are made of at least one selected from the group consisting of a Co—Mo—Cr—Si alloy comprising by mass 27.5-30.0% of Mo, 7.5-10.0% of Cr, and 2.0-4.0% of Si, the balance being Co and inevitable impurities; an Fe—Mo—Cr—Si alloy comprising by mass 27.5-30.0% of Mo, 7.5-10.0% of Cr, and 2.0-4.0% of Si, the balance being Fe and inevitable impurities; a Co—Cr—W—C alloy comprising by mass 27.0-32.0% of Cr, 7.5-9.5% of W, and 1.4-1.7% of C, the balance being Co and inevitable impurities; a Co—Cr—W—C alloy comprising by mass 27.0-32.0% of Cr, 4.0-6.0% of W, and 0.9-1.4% of C, the balance being Co and inevitable impurities; and a Co—Cr—W—C alloy comprising by mass 28.0-32.0% of Cr, 11.0-13.0% of W, and 2.0-3.0% of C, the balance being Co and inevitable impurities.

2. The sintered valve seat according to claim 1, wherein said first hard particles having hardness of 550-2400 HV0.1 are dispersed in an amount of 10-35% by mass in said sintered valve seat.

3. The sintered valve seat according to claim 2, wherein said first hard particles have hardness of 550-900 HV0.1.

4. The sintered valve seat according to claim 1, wherein hardness difference between the lowest-hardness particles among said first hard particles and the highest-hardness particles among said second hard particles is 30 HV0.1 or more.

5. The sintered valve seat according to claim 1, wherein said first hard particles and said second hard particles respectively have a median diameter of 10-150 μm.

6. The sintered valve seat according to claim 1, wherein said sintered valve seat contains up to 7% by mass of Sn.

7. The sintered valve seat according to claim 1, wherein said sintered valve seat contains up to 1% by mass of a solid lubricant.

8. The sintered valve seat according to claim 7, wherein said solid lubricant is at least one selected from the group consisting of C, BN, MnS, $CaF_2$, $WS_2$ and $Mo_2S$.

9. The sintered valve seat according to claim 1, wherein said first hard particles further comprise at least one selected from the group consisting of an Fe—Mo—Si alloy comprising by mass 40-70% of Mo, and 0.4-2.0% of Si, the balance being Fe and inevitable impurities, and SiC.

10. The sintered valve seat according to claim 1, wherein said second hard particles are made of at least one selected from the group consisting of alloy tool steel comprising by mass 1.4-1.6% of C, 0.4% or less of Si, 0.6% or less of Mn, 11.0-13.0% of Cr, 0.8-1.2% of Mo, and 0.2-0.5% of V, the balance being Fe and inevitable impurities; alloy tool steel comprising by mass 0.35-0.42% of C, 0.8-1.2% of Si, 0.25-0.5% of Mn, 4.8-5.5% of Cr, 1-1.5% of Mo, and 0.8-1.15% of V, the balance being Fe and inevitable impurities; high-speed tool steel comprising by mass 0.8-0.88% of C, 0.45% or less of Si, 0.4% or less of Mn, 3.8-4.5% of Cr, 4.7-5.2% of Mo, 5.9-6.7% of W, and 1.7-2.1% of V, the balance being Fe and inevitable impurities; and low-alloy steel comprising by mass 0.01% or less of C, 0.3-5.0% of Cr, and 0.1-2.0% of Mo, the balance being Fe and inevitable impurities.

11. A sintered valve seat comprising hard particles dispersed in a matrix of Cu or its alloy, said hard particles being composed of first hard particles and second hard particles;

the total amount of said first and second hard particles being 25-70% by mass;

said second hard particles having hardness of 300-650 HV0.1, lower than that of said first hard particles; and said sintered valve seat containing 0.08-2.2% by mass of P, wherein said second hard particles are made of at least one selected from the group consisting of alloy tool steel comprising by mass 1.4-1.6% of C, 0.4% or less of Si, 0.6% or less of Mn, 11.0-13.0% of Cr, 0.8-1.2% of Mo, and 0.2-0.5% of V, the balance being Fe and inevitable impurities; alloy tool steel comprising by mass 0.35-0.42% of C, 0.8-1.2% of Si, 0.25-0.5% of Mn, 4.8-5.5% of Cr, 1-1.5% of Mo, and 0.8-1.15% of V, the balance being Fe and inevitable impurities; high-speed tool steel comprising by mass 0.8-0.88% of C, 0.45% or less of Si, 0.4% or less of Mn, 3.8-4.5% of Cr, 4.7-5.2% of Mo, 5.9-6.7% of W, and 1.7-2.1% of V, the balance being Fe and inevitable impurities; and low-alloy steel comprising by mass 0.01% or less of C, 0.3-5.0% of Cr, and 0.1-2.0% of Mo, the balance being Fe and inevitable impurities.

12. The sintered valve seat according to claim 11, wherein said first hard particles having hardness of 550-2400 HV0.1 are dispersed in an amount of 10-35% by mass in said sintered valve seat.

13. The sintered valve seat according to claim 12, wherein said first hard particles have hardness of 550-900 HV0.1.

14. The sintered valve seat according to claim 11, wherein hardness difference between the lowest-hardness particles among said first hard particles and the highest-hardness particles among said second hard particles is 30 HV0.1 or more.

15. The sintered valve seat according to claim 11, wherein said first hard particles and said second hard particles respectively have a median diameter 10-150 μm.

16. The sintered valve seat according to claim 11, wherein said sintered valve seat contains up to 7% by mass of Sn.

17. The sintered valve seat according to claim 11, wherein said sintered valve seat contains up to 1% by mass of a solid lubricant.

18. The sintered valve seat according to claim 17, wherein said solid lubricant is at least one selected from the group consisting of C, BN, MnS, $CaF_2$, $WS_2$ and $Mo_2S$.

19. The sintered valve seat according to claim 11, wherein said first hard particles further comprise at least one selected from the group consisting of an Fe—Mo—Si alloy comprising by mass 40-70% of Mo, and 0.4-2.0% of Si, the balance being Fe and inevitable impurities, and SiC.

* * * * *